US008615814B1

(12) United States Patent
Hawkins

(10) Patent No.: US 8,615,814 B1
(45) Date of Patent: Dec. 31, 2013

(54) MULTI-TASKING HANDWARMER

(76) Inventor: Randy Hawkins, Travelers Rest, SC (US)

( * ) Notice: Subject to any disclaimer, the term of this patent is extended or adjusted under 35 U.S.C. 154(b) by 66 days.

(21) Appl. No.: 13/049,255

(22) Filed: Mar. 16, 2011

Related U.S. Application Data

(63) Continuation-in-part of application No. 12/701,891, filed on Feb. 8, 2010.

(60) Provisional application No. 61/150,925, filed on Feb. 9, 2009, provisional application No. 61/229,906, filed on Jul. 30, 2009.

(51) Int. Cl.
*A41D 5/00* (2006.01)

(52) U.S. Cl.
USPC ..... 2/66

(58) Field of Classification Search
USPC ..... 2/59, 60, 66, 16, 208, 69, 158, 159, 2/456, 247, 250, 252, 253, 160
See application file for complete search history.

(56) References Cited

U.S. PATENT DOCUMENTS

| | | | | | |
|---|---|---|---|---|---|
| 104,780 | A | * | 6/1870 | Seldis | 2/66 |
| 347,879 | A | * | 8/1886 | Kosminski | 2/66 |
| 369,817 | A | * | 9/1887 | Salamon | 2/66 |
| 2,727,241 | A | * | 12/1955 | Smith | 2/66 |
| 2,751,952 | A | | 6/1956 | Mirus | |
| 2,835,896 | A | * | 5/1958 | Giese | 2/66 |
| 4,415,106 | A | * | 11/1983 | Connell et al. | 224/221 |
| 4,426,739 | A | * | 1/1984 | Wadsworth | 2/16 |
| 4,495,659 | A | * | 1/1985 | Madnick et al. | 2/66 |
| 4,746,043 | A | * | 5/1988 | Booker | 224/219 |
| 4,862,519 | A | * | 9/1989 | Bull | 2/66 |
| 4,893,357 | A | * | 1/1990 | Evans | 2/208 |
| 4,949,887 | A | * | 8/1990 | Holmes | 224/577 |
| 5,101,512 | A | * | 4/1992 | Weinstein | 2/84 |
| 5,139,187 | A | * | 8/1992 | Fowler | 224/576 |
| 5,269,023 | A | * | 12/1993 | Ross | 2/66 |
| 5,461,728 | A | | 10/1995 | Staszak | |
| 5,477,633 | A | * | 12/1995 | Leinberger | 40/661 |
| 5,499,401 | A | * | 3/1996 | Heinmiller | 2/208 |
| 5,924,135 | A | * | 7/1999 | Worth | 2/125 |
| 5,987,648 | A | * | 11/1999 | Boyd | 2/195.1 |
| 6,389,599 | B2 | | 5/2002 | Spiegel | |
| 6,463,608 | B1 | * | 10/2002 | Moe | 5/646 |
| 7,168,098 | B2 | * | 1/2007 | West | 2/93 |
| 7,380,287 | B2 | * | 6/2008 | DeSantis | 2/123 |
| 7,467,423 | B1 | * | 12/2008 | Tawfik | 2/207 |
| 7,496,969 | B2 | * | 3/2009 | Pieczynski | 2/16 |
| D595,928 | S | * | 7/2009 | Swanson | D2/611 |
| 7,614,434 | B2 | * | 11/2009 | DeMichele | 150/145 |
| 2004/0064870 | A1 | | 4/2004 | Gold | |

(Continued)

*Primary Examiner* — Khoa Huynh
*Assistant Examiner* — Andrew W Collins
(74) *Attorney, Agent, or Firm* — Dority & Manning, P.A.

(57) ABSTRACT

The main body of the hand muff of the present invention includes a generally cylindrical member having an opening at each opposite end thereof. A viewing panel forms a section of a generally cylindrical wall of the main body of the hand muff. The viewing panel can be formed of one or both of solid transparent material and screen mesh material. A selectively removable cover flap permits the user to see inside the muff when the free edge of the cover flap is selectively detached from the body of the muff. A pocket with a closure is provided inside the body of the muff and is configured to hold a cell phone, a personal digital assistant and the like handheld device.

20 Claims, 17 Drawing Sheets

(56) References Cited

U.S. PATENT DOCUMENTS

| | | | | |
|---|---|---|---|---|
| 2004/0154076 | A1* | 8/2004 | Yoo | 2/247 |
| 2006/0075537 | A1* | 4/2006 | Tsai | 2/69 |
| 2006/0206990 | A1* | 9/2006 | Demus | 2/247 |
| 2006/0248624 | A1* | 11/2006 | Pieczynski | 2/16 |
| 2006/0253963 | A1* | 11/2006 | Limbaugh | 2/247 |
| 2010/0175161 | A1 | 7/2010 | Jarboe | |
| 2010/0299800 | A1* | 12/2010 | Jackson, Jr. | 2/69 |
| 2012/0060261 | A1* | 3/2012 | Raviv | 2/252 |
| 2012/0185991 | A1* | 7/2012 | Veytsman | 2/50 |

* cited by examiner

Fig. 9F
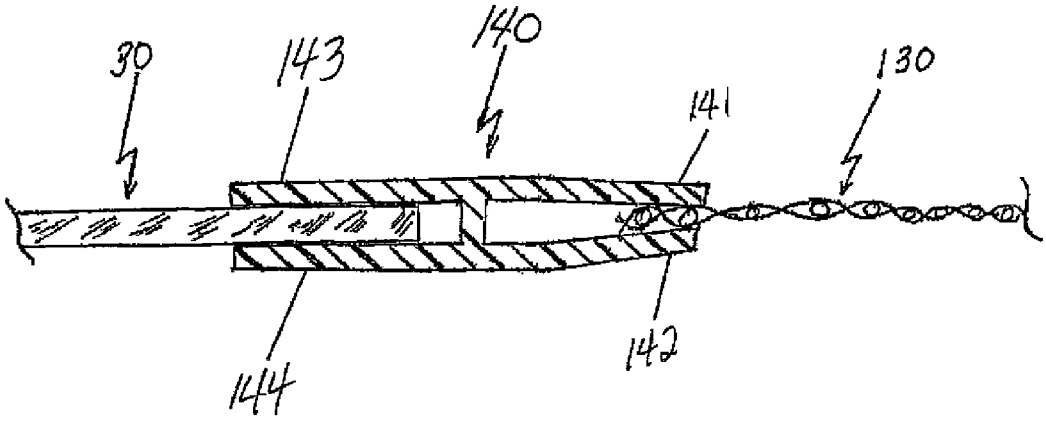
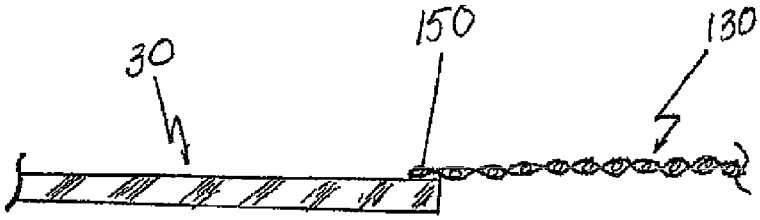
Fig. 9G

MULTI-TASKING HANDWARMER

CROSS-REFERENCE TO RELATED APPLICATIONS

This application is a continuation-in-part of and claims benefit to Ser. No. 12/701,891 filed Feb. 8, 2010, which claimed the benefit of the following U.S. provisional patent applications: Ser. No. 61/150,925 filed Feb. 9, 2009 and Ser. No. 61/229,906 filed Jul. 30, 2009, the complete disclosures of each of the three foregoing applications being hereby incorporated herein by this reference for all purposes.

STATEMENT REGARDING FEDERALLY SPONSORED RESEARCH OR DEVELOPMENT

N/A

BACKGROUND OF THE INVENTION

The present invention relates to a muff that is used for keeping the hands warm.

Muffs are well known fashion accessories for keeping the hands warm and usually are composed of a cylinder of fur or fabric with insulation and have both opposite ends of the cylinder open so that a person's hands can be inserted from each end into the muff to keep the hands warm.

OBJECTS AND SUMMARY OF THE INVENTION

It is a principal object of the present invention to provide an improved muff (aka a hand warmer).

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out below.

To achieve the objects and in accordance with the purpose of the invention, as embodied and broadly described herein, the item known as a muff or hand warmer comprises a main body that includes a generally cylindrical member having a generally cylindrical side wall and an opening at each opposite end thereof. The cylindrical side wall defines a viewing opening through the side wall. A viewing panel is connected to the cylindrical side wall and disposed across the viewing opening so as to be framed by the viewing opening, and thus a viewing panel forms a section of the generally cylindrical side wall. The viewing panel can be composed entirely of a flexible mesh panel. The viewing panel can be composed entirely of a flexible transparent panel. The viewing panel can be comprised of at least one flexible mesh panel and at least one flexible transparent panel. A cover flap that is selectively removable from either inside or outside the generally cylindrical member permits the user to see inside the muff through the viewing panel when the cover flap is disconnected from the main body of the muff. A pocket with a closure is provided inside the body of the muff and is configured to hold a handheld device such as a cell phone, a digital assistant, a global positioning device, an electronic calculator and the like handheld device.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

BRIEF DESCRIPTION OF THE DRAWINGS

FIG. 9F is a cross-sectional view taken in the direction indicated by the arrows designated 9F-9F in FIG. 9D.

FIG. 9G is cross-sectional view taken in the direction indicated by the arrows designated 9G-9G in FIG. 9E.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
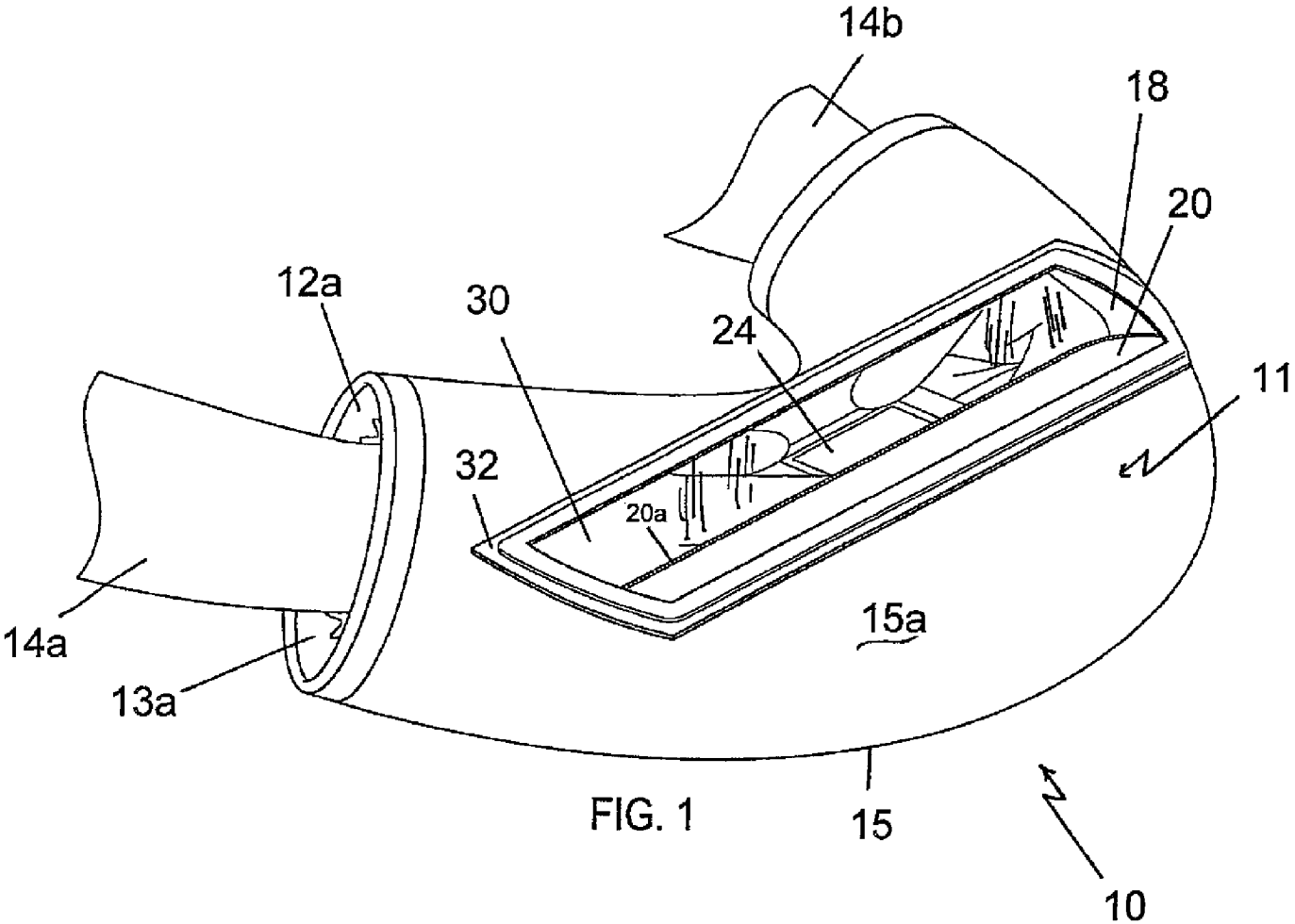
FIG. 1 is an elevated perspective view of a presently preferred embodiment of the muff of the present invention.

An illustrative embodiment of the muff is shown in FIG. 1 and is represented generally by the numeral 10. The user's wrists and hands and part of the user's forearms 14*a*, 14*b* are shown inserted into the muff 10 as the user is manipulating a hand-held device 24 such as a cell phone, a digital assistant, a global positioning device, an electronic calculator and the like handheld device.

As shown in FIGS. 1-4, 7A, 7B, 7C, 8, 9A, 9B, 9C, 9D, 9E and 10 for example, alternative embodiments of the hand muff 10, 110, 210, 310, 410, 510, 610, 710, 810, 910, 1010 of the present invention include a generally hollow main body that is non-rigid and includes heat-insulating material. The main body desirably is configured with a generally cylindrical shape with open opposite ends and can include a bend in the shape between the ends thereof. As shown in FIGS. 1 and 6-9E and 10 for example, the main body of the muff 110, 210, 310, 410, 510, 610, 710, 810, 910, 1010 is defined by a generally cylindrical member 11 having an opening 12*a*, 12*b* at each opposite end thereof. A cuff 13*a*, 13*b* can be attached to the periphery of each of the respective openings 12*a*, 12*b* in the opposed ends of the cylindrical member 11. As shown in FIG. 1 for example, each cuff 13*a*, 13*b* itself defines a narrower opening than its respective opening 12*a*, 12*b* defined in the respective end of the cylindrical member 11 and serves to form a seal around the forearm 14*a*, 14*b* of the user. Accordingly, as shown in FIGS. 7A, 7B, 7C, 9A, 9B, 9C, 9D and 9E for example, each cuff 13*a*, 13*b* desirably can be provided with an elastic portion 31 that is configured to grip the forearm 14*a*, 14*b* of the user when the user's hand is inserted inside the muff 10.

As shown in FIGS. 1-9E and 10 for example, the cylindrical member 11 can include a cylindrical side wall that desirably can include an outermost exterior wall 15, which desirably is formed of non-rigid, flexible material such as vinyl or cloth, which can be composed of natural fibers, synthetic fibers or a combination of both natural and synthetic fibers. The exterior wall 15 has an outer surface 15*a* that is visible from outside the muff 10 and desirably can be treated so as to be waterproof. The outer surface 15*a* of the exterior wall 15 desirably can be decorated so as to display any of a number of desired appearances. The decoration can display a camouflage pattern that might be useful to hunters. The decoration can display the colors and/or logos of a sporting team or school so that such decoration might be desirable to fans of the team or school.

As shown in FIGS. 3-6 for example, the cylindrical side wall of the cylindrical member 11 can include an innermost interior wall 16, which desirably is formed of non-rigid, flexible material such as cloth. The interior wall 16 is disposed in opposition to the exterior wall 15, and desirably an annular space is defined between the interior wall 16 and the exterior wall 15. As most easily seen in FIGS. 5 and 6 for example, the annular space between the interior wall 16 and the exterior wall 15 desirably can be filled with a layer 17 of non-rigid, heat insulating material. In alternative embodiments, the cylindrical side wall that defines the cylindrical member 11 can be formed of fewer than three layers, and a single sheet of non-rigid, heat-insulating material can be substituted for one or more of the three layers of the exterior wall 15, the interior wall 16 and the insulating layer 17.

Figure 2:
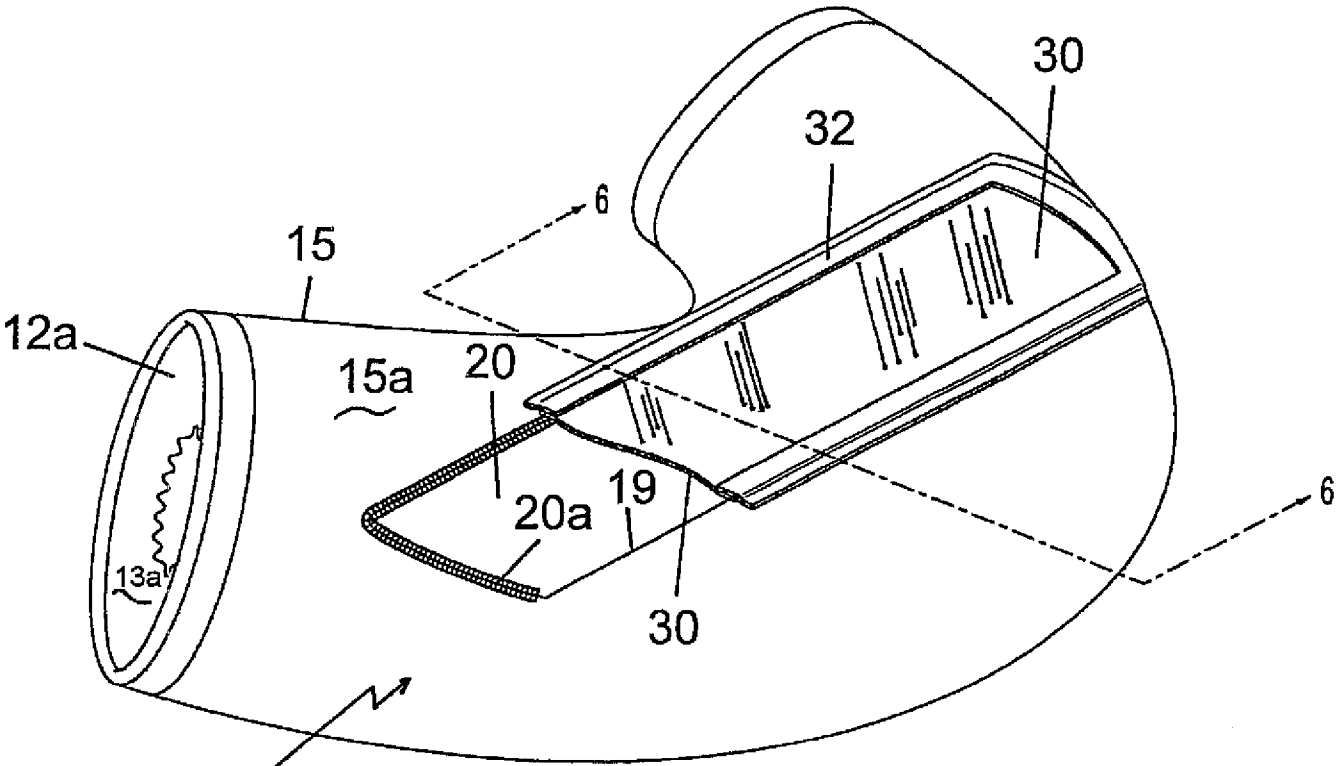
FIG. 2 is an elevated perspective view of the embodiment of FIG. 1 with portions partly cut away.
Figure 6:
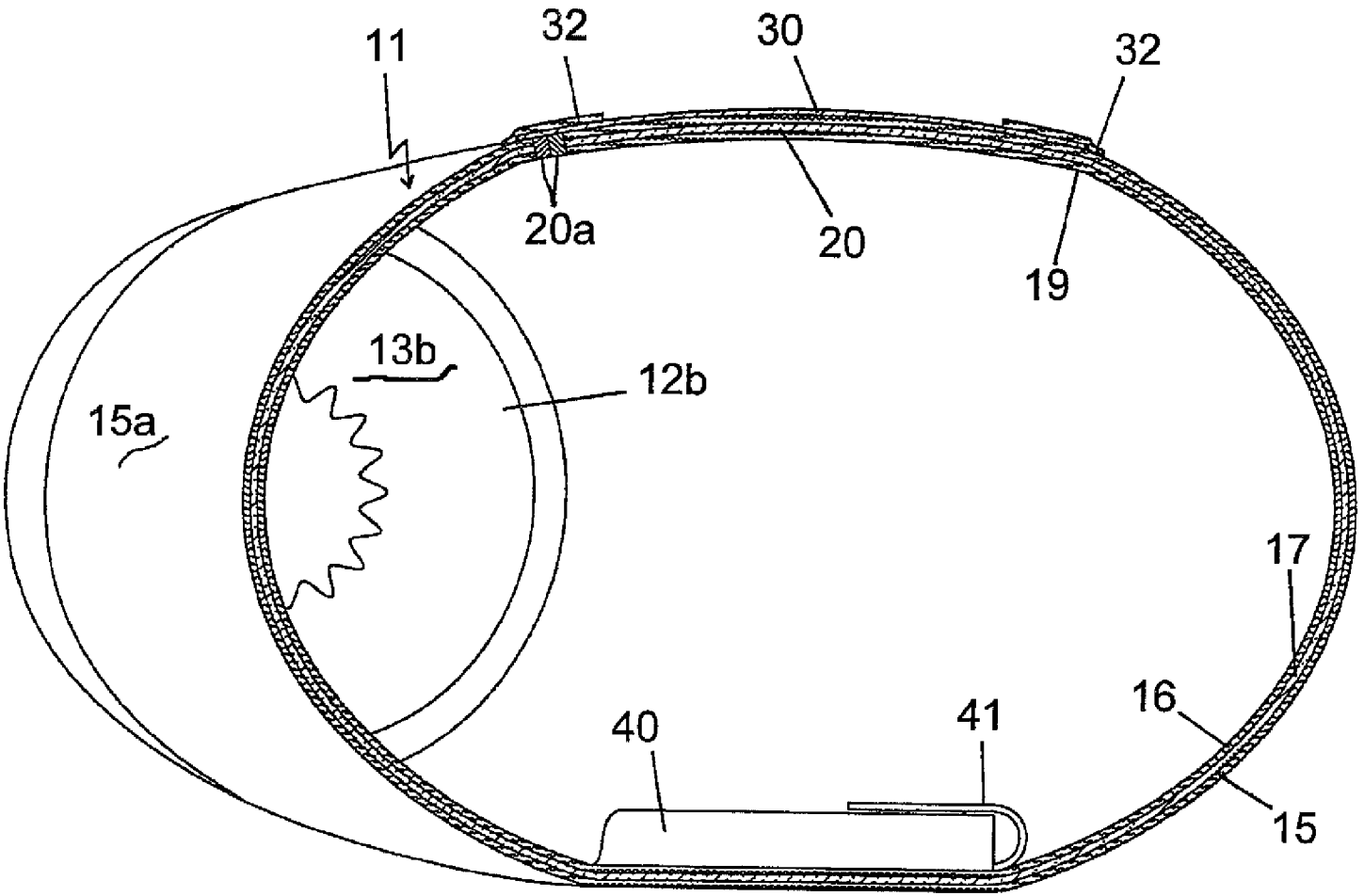
FIG. 6 is an elevated perspective view of the embodiment of FIG. 1 with portions partly cut away and portions partly shown in cross-section taken along the line of sight of the arrows designated by the numerals 6 in FIG. 2.

As most easily seen in FIGS. 1, 2 and 6 for example, a cut through the exterior wall 15, the interior wall 16 and the insulating layer 17 can define an outline through the cylindrical member 11 so as to define a viewing opening 18 and a hinged cover flap 20, which is pivotally connected to the cylindrical member 11. The cover flap 20 is pivotally connected to the cylindrical side wall and configured and disposed so as to selectively cover the viewing opening 18 in a closed position and uncover the viewing opening 18 in an open position. The shape of the outline shown in FIGS. 1 and 2 is three sides of a rectangle, with one of the longer sides forming the hinge 19 (FIGS. 2, 7A, 9A, 9D and 9E for example) of the cover flap 20. However, other shapes for the outline and viewing opening 18 can be used, and a curved shape for the outline and viewing opening 18 is also desirable. The viewing opening 18 desirably is formed through the portion of the muff 10 that is the top of the muff 10 when the user's hands are disposed inside the muff 10 so that the user's eyes can look through the viewing opening 18 into the interior of the muff 10.

A viewing panel desirably is positioned to extend across the entire span of the viewing opening 18 and desirably is attached permanently to the cylindrical member 11. As shown in FIGS. 1-4 and 6-8 for example, the viewing panel can be defined in its entirety by a transparent panel 30 that forms a section of the generally cylindrical member 11 that forms the main body of the hand muff 10, 110, 210, 310, 410. Depending on the size and shape of the transparent panel 30 in relation to the size and shape of the cylindrical member 11 that forms the main body of the muff embodiments 110, 210, 310, 410 shown in FIGS. 7A, 7B, 7C and 8, the transparent panel 30 desirably can be formed of a material such as clear plastic that is relatively flexible enough to conform generally to the shape of the muff in the region occupied by the panel 30. The transparent panel 30 can be formed of a thin, relatively rigid sheet of transparent plastic material that is flat planar or slightly curved. Alternatively, the transparent panel 30 can be formed of a thin, flexible sheet of transparent plastic material that is sufficiently flexible and resilient so that it is bendable without permanently creasing or breaking and without distorting visual perception through the transparent panel 30.

As shown in FIG. 1 by the positioning of the transparent panel 30, the viewing panel desirably is disposed in what would be considered the top section of the muff 10, which is the section that faces the user's eyes when the muff is in use. The transparent panel 30 is disposed across the viewing opening 18 and configured so as to span across the entire viewing opening 18 that is revealed when the free edge of the cover flap 20 is pivoted away from the main body 11 of the muff 10, 110, 210, 310, 410. The transparent panel 30 is connected to the cylindrical side wall of the cylindrical member 11 and disposed so as to be framed by the viewing opening 18. Desirably, as shown in FIGS. 1-4 and 6-7C for example, an attachment frame 32 is provided to secure the transparent panel 30 around the outer border section thereof to the region of the cylindrical member 11 surrounding the viewing opening 18. The cover flap 20 is pivotally connected to the cylindrical side wall and configured and disposed so as to selectively cover the transparent panel 30 in a closed position and uncover the transparent panel 30 in an open position.

In accordance with presently preferred embodiments of the invention, provision desirably is made to provide ventilation to the interior space inside of the muff. As shown in FIG. 7C for example, at least one ventilation hole 33, and desirably a plurality of small ventilation holes 33, desirably is defined through the otherwise solid and continuous transparent panel 30. These small ventilation holes 33 desirably can be disposed near the outer periphery of the transparent panel 30 and where the transparent panel 30 adjoins the cylindrical wall of the cylindrical member 11. As shown in FIG. 7C for example, ventilation holes 33 desirably are positioned near where the attachment frame 32 connects the outermost peripheral region of the transparent panel 30 to the cylindrical wall of the cylindrical member 11. These small ventilation holes 33 will be covered by one of the two cover flaps 20 when the cover flaps are attached in their closed positions and thereby protected from admitting soil or moisture into the interior space of the muff. One advantage of using the transparent panel 30 with the ventilation holes 33 becomes apparent when the muff is being used when there are cold temperatures and/or high humidity that causes water vapor to accumulate in the interior of the muff. These ventilation holes 33 allow the water vapor to escape and thereby avoid fogging the transparent panel 30 to such an extent that the user's view inside the muff is obscured sufficiently to render normal operation of the hand-held device difficult or impossible.

Figure 9A:
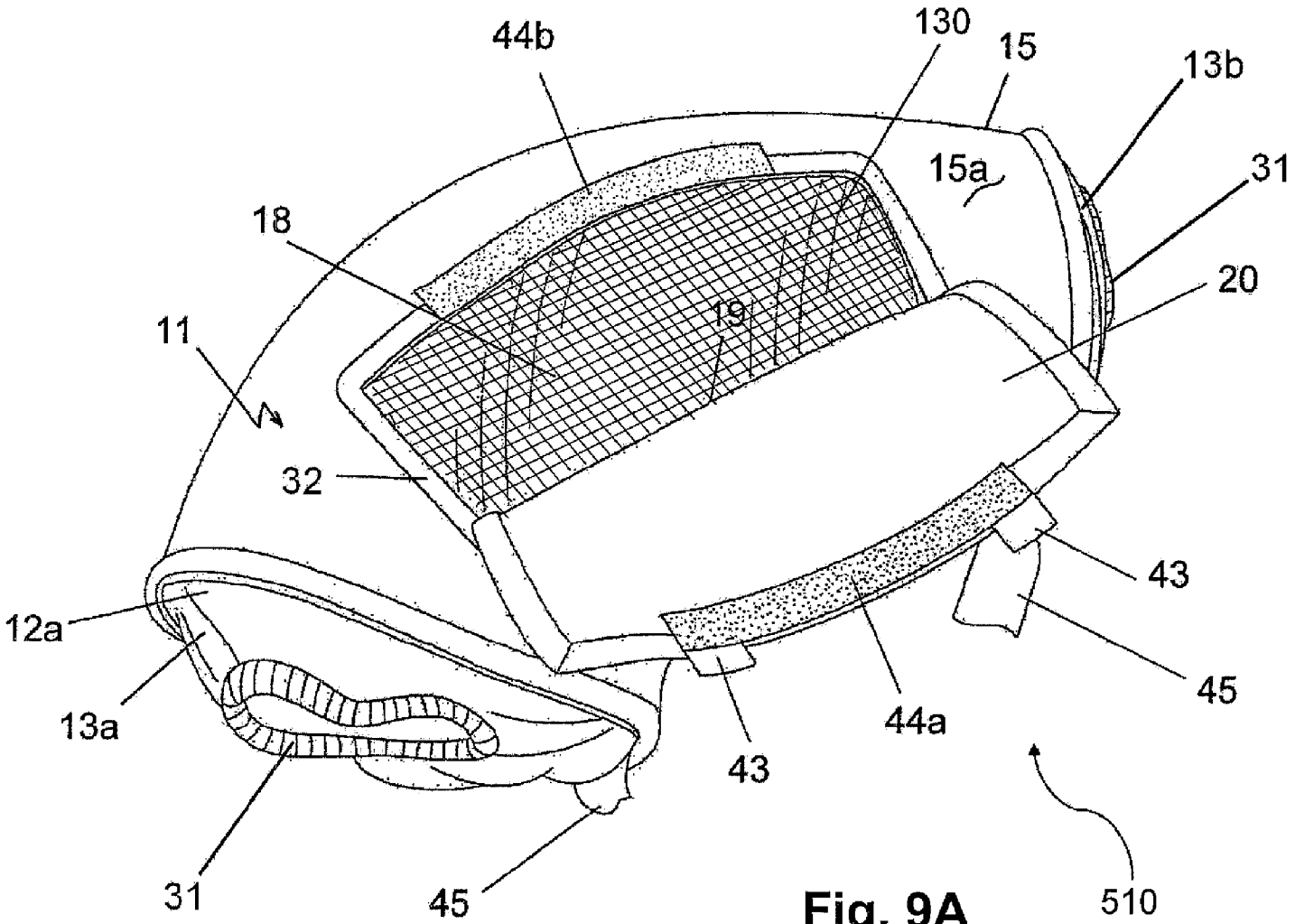
FIG. 9A is an elevated perspective view of another preferred embodiment of the muff of the present invention.
Figure 9B:
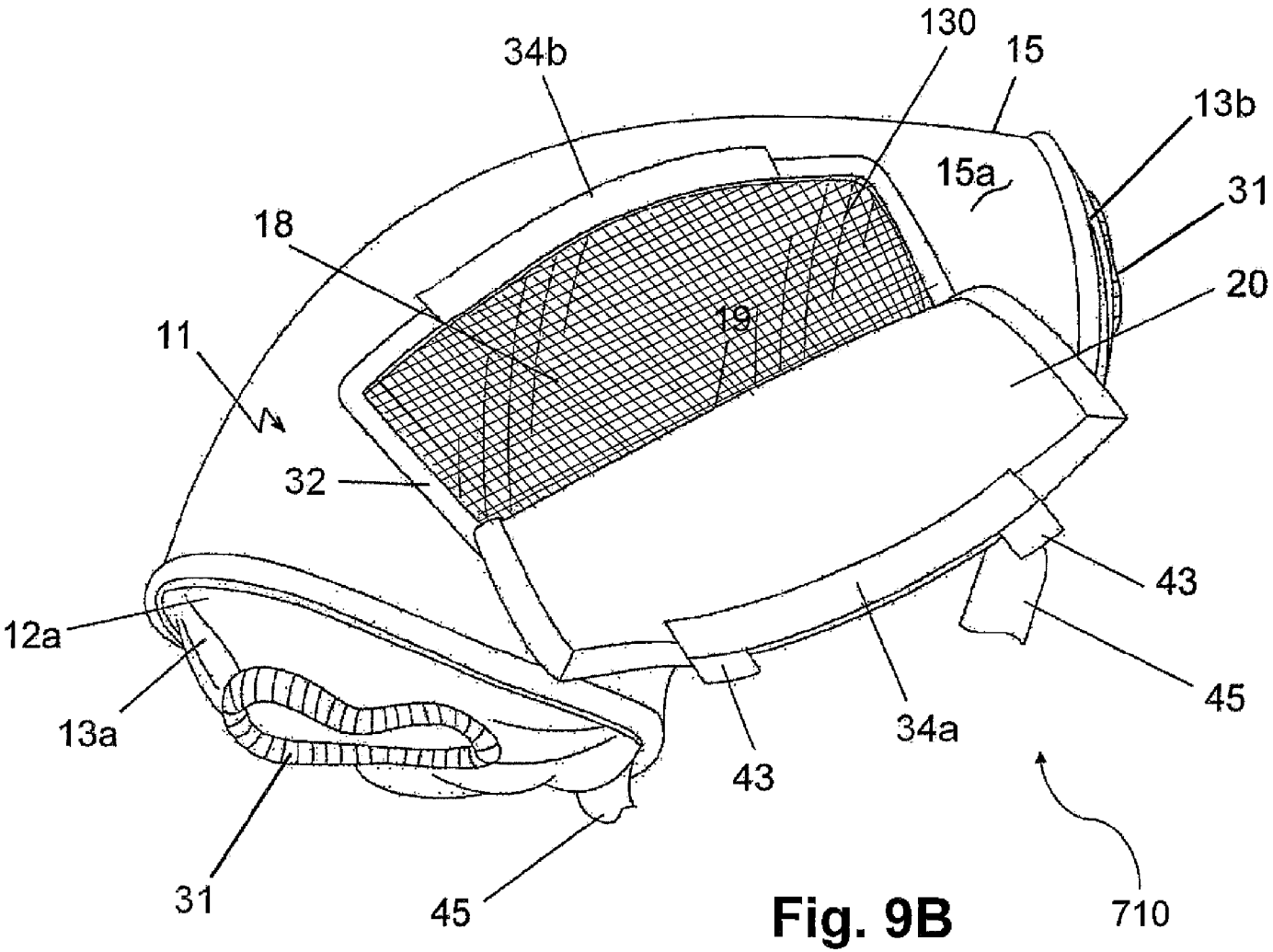
FIG. 9B is an elevated perspective view of another preferred embodiment of the muff of the present invention.
Figure 9C:
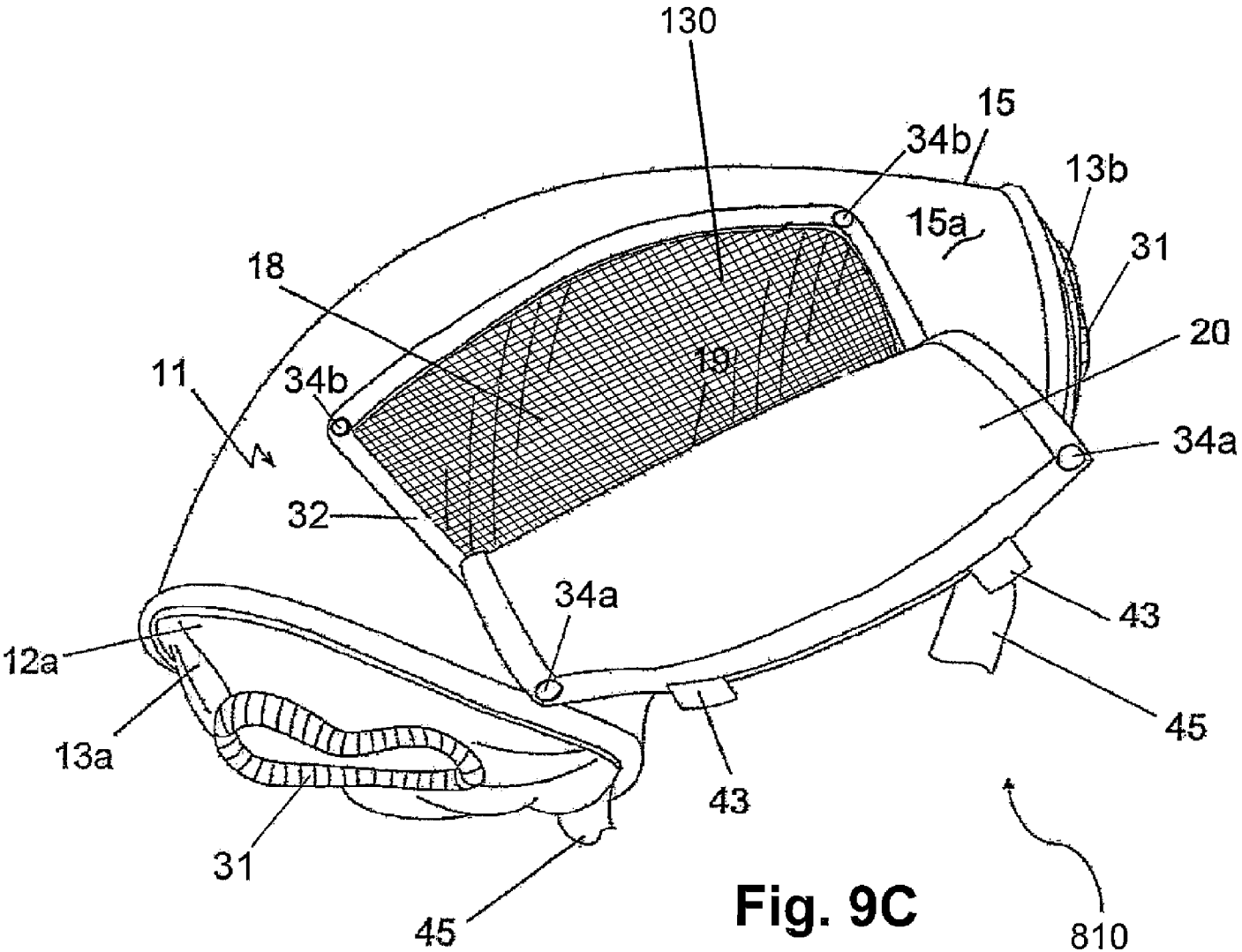
FIG. 9C is an elevated perspective view of another preferred embodiment of the muff of the present invention.
Figure 9D:
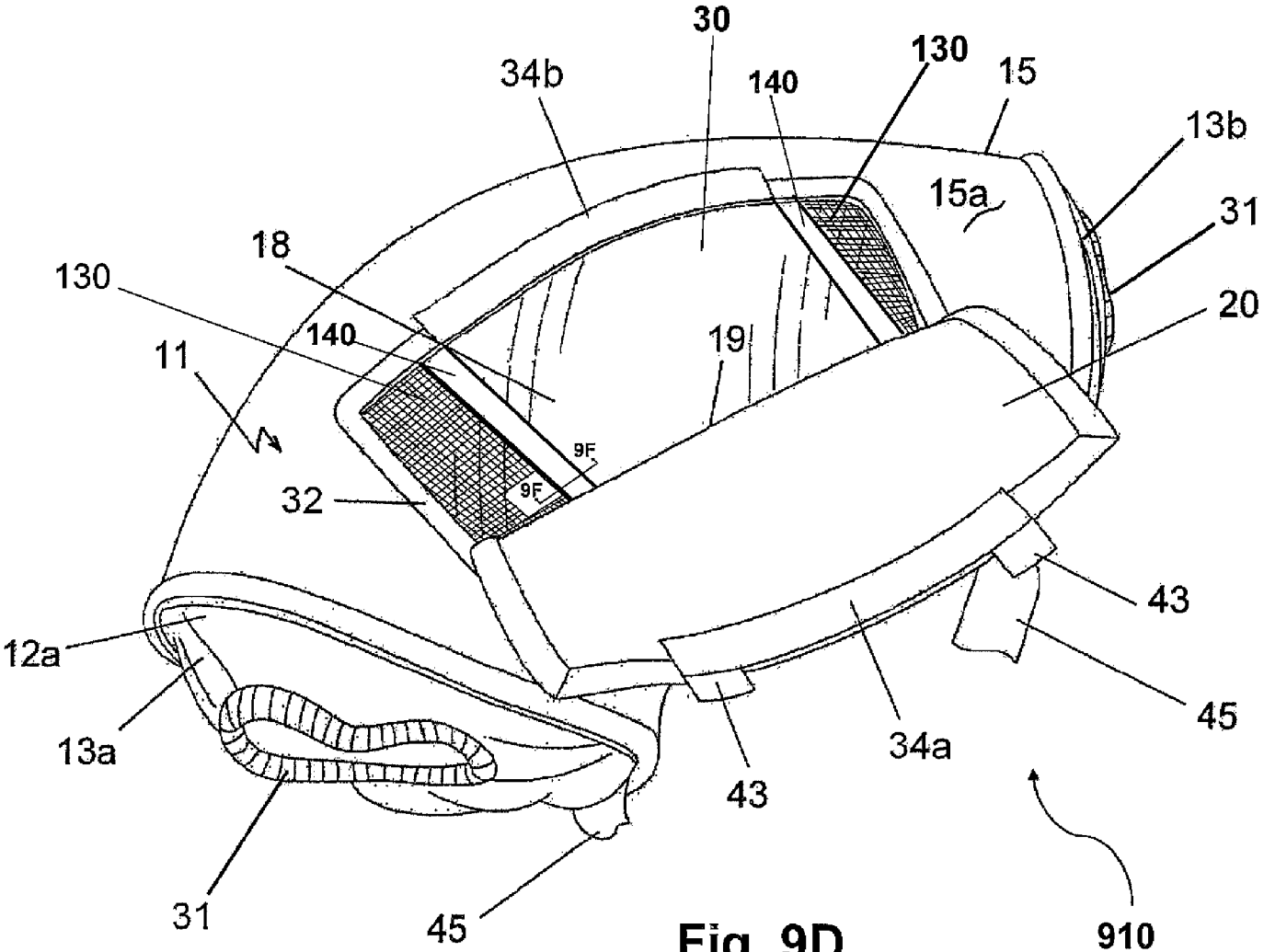
FIG. 9D is an elevated perspective view of another preferred embodiment of the muff of the present invention.
Figure 9E:
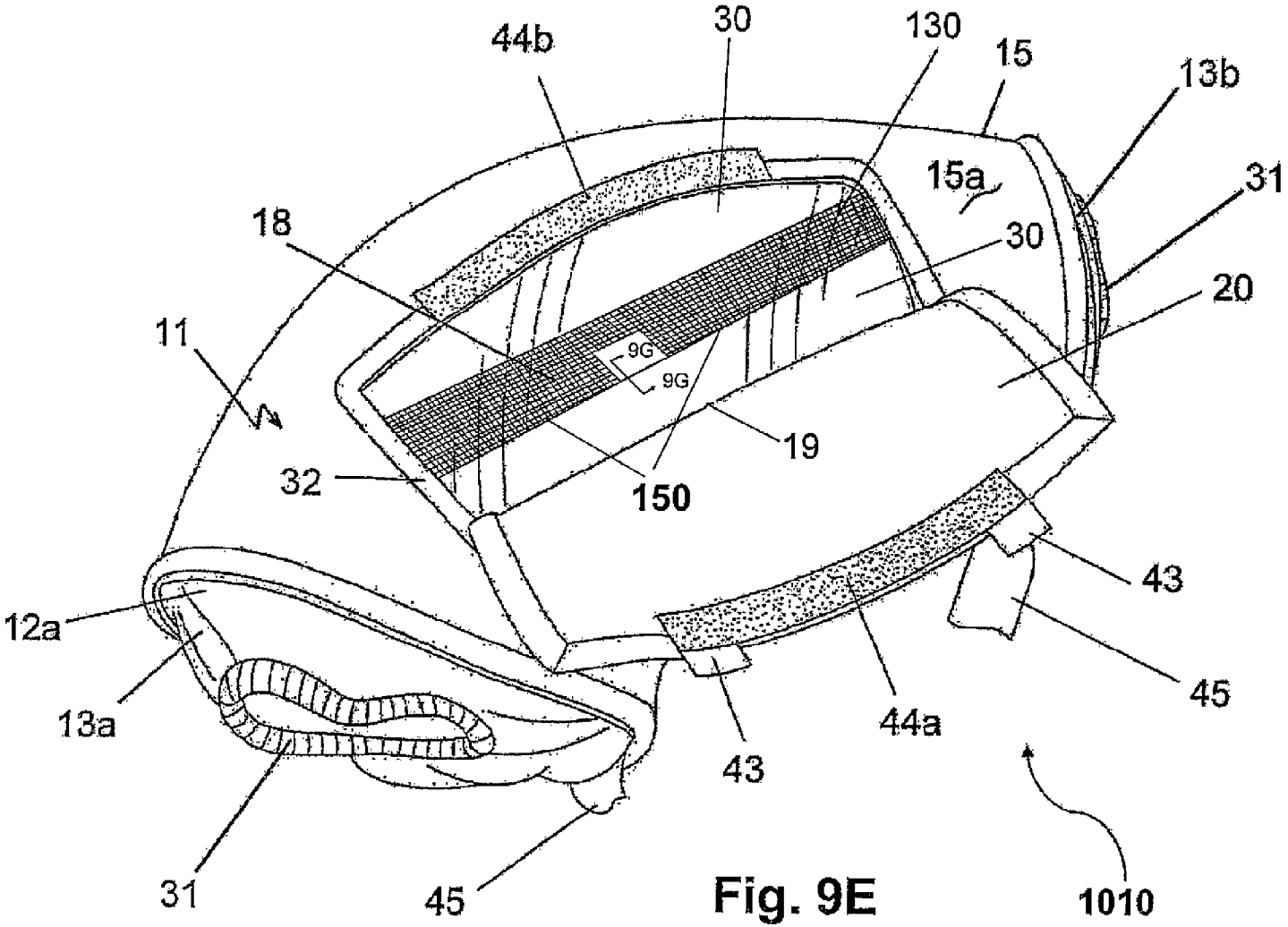
FIG. 9E is an elevated perspective view of another preferred embodiment of the muff of the present invention.

As shown in FIGS. 9A, 9B, 9C, 9D, 9E and 10 for example, the viewing panel can be defined at least partially by at least one flexible mesh panel 130 that desirably forms a section of the generally cylindrical member 11 that forms the main body of the hand muff 510, 610, 710, 810, 910, 1010. The flexible mesh panel 130 admits light and air into the interior space of the hand muff 510, 610, 710, 810, 910, 1010 and allows water vapor to escape from the interior space of the hand muff 510, 610, 710, 810, 910, 1010. As shown in FIGS. 9A, 9B, 9C and 10 for example, the viewing panel can be defined in its entirety by one continuous flexible mesh panel 130 that forms a section of the generally cylindrical member 11 that forms the main body of the hand muff 510, 610, 710, 810. As shown in FIGS. 9D and 9E for example, the viewing panel can be comprised of at least one flexible mesh panel 130 and at least one transparent panel 30. In the embodiment depicted in FIG. 9D for example, a transparent panel 30 is flanked on each of its shorter side edges by one of two flexible mesh panels 130 that comprise the viewing panel. In the embodiment depicted in FIG. 9E for example, one flexible mesh panel 130 is flanked on each of its longer side edges by one of two transparent panels 30 that comprise the viewing panel. Moreover, other relative arrangements of the respective flexible mesh panel(s) 130 and transparent panel(s) 30 are contemplated.

Each flexible mesh panel 130 desirably is formed of thin strands of fiberglass, nylon, polyester or other synthetic fiber mesh that is pliable enough to bend with the rest of the muff under normal usage conditions without permanently creasing at the bend axis. As depicted in FIGS. 9A, 9B, 9C, 9D and 9E, the sizes of the openings of each flexible mesh panel 130 that are depicted in these Figs. are approximately equal to the actual sizes of the openings of each flexible mesh panel 130. As depicted in FIG. 9A for example, each flexible mesh panel 130 desirably is woven in a pattern with square-shaped openings that measure about three millimeters by three millimeters. Suitable flexible mesh panel 130 is available from Saint-Gobain Technical Fabrics Americas, Inc. of Grand Island, N.Y. 14072 (sgtf.com) as New York Wire screening part #94196. However, as depicted in FIG. 9E for example, openings that measure about one millimeter by one millimeter also can be used.

The fineness of a screen mesh also can be measured in strands per inch on the warp (length) and the weft or filler (width). A screen mesh in the range of 8 strands per inch by 8 strands per inch on the larger end of the spectrum to 30 strands per inch by 30 strands per inch on the smaller end of the spectrum should be suitable for the flexible mesh panel 130. An 18 strands per inch by 14 strands per inch mesh screen also can be used for the flexible mesh panel 130 as can an 18 strands per inch by 18 strands per inch mesh screen. Openings of other shapes, e.g., diamonds, ovals, circles, rectangles, triangles, etc., also can be used. The sizes of the openings on the smaller end of the spectrum must be large enough to allow the wearer to see through the mesh screen 130 into the interior of the muff and allow water vapor to escape from within the muff into the ambient air when the cover flap 20 is open. The sizes of the openings on the larger end of the spectrum desirably should not be so large that items stored inside the muff can fall through the openings or that allow the fingers of wearer to poke through the openings and get hung up in the openings during use.

Each flexible mesh panel 130 desirably is sufficiently flexible and bendable so that it can drape and conform itself roughly to the general shape of a rigid body in a manner similar to the way cloth is able to do without permanently assuming such shape. The flexibility and bendability of the flexible mesh panel 130 is schematically indicated by the slightly curved diagonal lines in FIGS. 9A, 9B, 9C, 9D, 9E and 10.

As shown in FIGS. 9A, 9B, 9C, 9D, 9E and 10, each flexible mesh panel 130 desirably is disposed in what would be considered the top section of the muff 510, 610, 710, 810, 910, 1010 when the muff is in use. Each flexible mesh panel 130 is connected to the cylindrical side wall of the cylindrical member 11 by conventional means such as adhesive or heat fusing for example. Each flexible mesh panel 130 is disposed so as to be framed at least in part by the viewing opening 18. In the embodiments depicted in FIGS. 9A, 9B, 9C and 10, a single flexible mesh panel 130 is disposed across the entire viewing opening and configured so as to cover the entire viewing opening 18 that is revealed when the free edge of the cover flap 20 is pivoted away from the main body 11 of the muff 510, 610, 710, 810, and the entire peripheral edge of the single flexible mesh panel 130 is framed by the viewing opening 18.

Desirably, as shown in FIGS. 9A, 9B, 9C, 9D and 9E for example, an attachment frame 32 is provided to secure each flexible mesh panel 130 around the outer border section thereof to the region of the cylindrical member 11 surrounding the viewing opening 18. The cover flap 20 is pivotally connected to the cylindrical side wall and configured and disposed so as to selectively cover each flexible mesh panel 130 in a closed position and uncover each flexible mesh panel 130 in an open position. The embodiments with the flexible mesh panel 130 are presently preferred especially for use in very cold weather when moisture from the wearer's hands and forearms otherwise might condense on the transparent panel 30 and fog the panel 30 and thus impair or prevent the wearer's ability to see through the fogged transparent panel 30 into the interior space of the muff.

As schematically shown in FIGS. 9D and 9F, one way of connecting one edge of a flexible mesh panel 130 with an opposing edge of a transparent panel 30 is by a mechanical connector 140, which conventionally can be made of deformable metal or plastic that retains the deformed shape. As shown in a cross-sectional view in FIG. 9F, one edge portion of a flexible mesh panel 130 is received in the space defined between a first pair of opposing flanges 141, 142, which can be crimped together to grip the flexible mesh panel 130 like opposing jaws. Disposed opposite the first pair of opposing flanges 141, 142, the mechanical connector 140 desirably defines a second pair of opposing flanges 143, 144. One edge portion of a transparent panel 30 desirably is received in the space defined between the second pair of opposing flanges 143, 144, which can be crimped together to grip the transparent panel 30 like opposing jaws.

As schematically shown in FIGS. 9E and 9G, another way of connecting one edge of a flexible mesh panel 130 with an opposing edge of a transparent panel 30 is by adhering or fusing the edge of the flexible mesh panel 130 to the opposing edge of the transparent panel 30. This adherence or fusion can be accomplished by a region of adhesion 150 that can be created in any of several ways. For example, one desirably could use one or more of a chemical adhesive, a heat weld or a sonic weld. As shown in a cross-sectional view in FIG. 9G and perspective view in FIG. 9E, one edge portion of a flexible mesh panel 130 is adhered or fused to the opposing edge of the transparent panel 30 at a region of adhesion (or fusion) 150 that desirably extends continuously for the full length of the opposing edges of each panel 130, 30.

Figure 10:
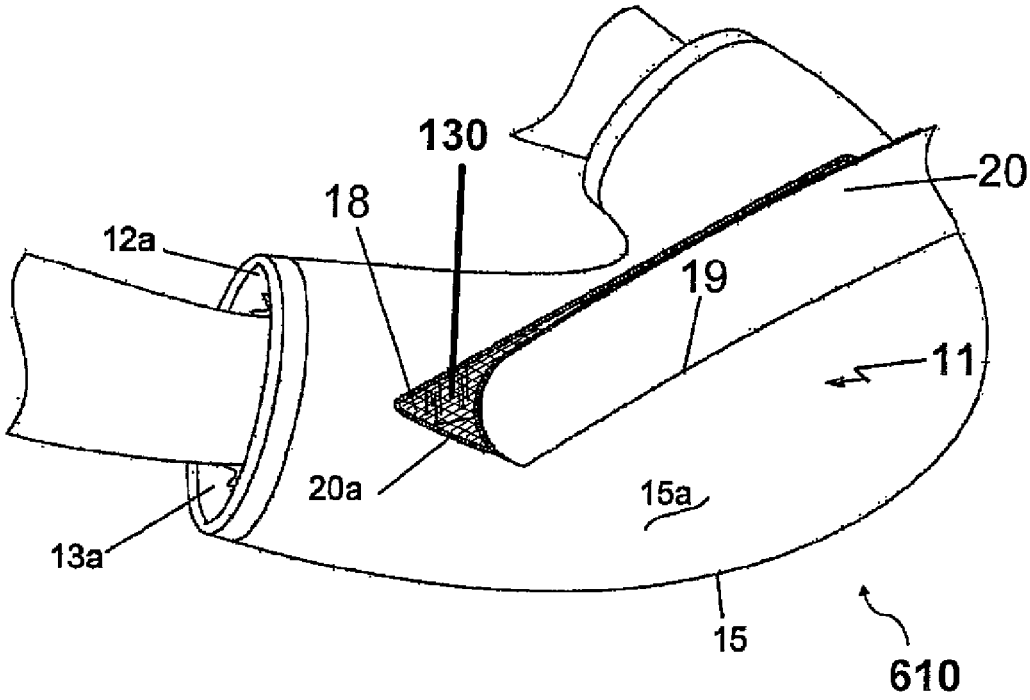
FIG. 10 is an elevated perspective view of another preferred embodiment of the muff of the present invention.

In the embodiment shown in FIGS. 1-4 and 6, the attachment frame 32 desirably is attached to the exterior wall 15 of the cylindrical member 11 and around the cut that outlines the viewing opening 18 through the cylindrical member 11. In the embodiments shown in FIGS. 7A, 7B, 7C, 9A, 9B, 9C, 9D and 9E, the cut is defined completely around the viewing opening 18 such that the flap 20 initially is completely detached and must be reattached to define the hinge 19, and the attachment frame 32 desirably is attached to the exterior wall 15 of the cylindrical member 11 and to the flap 20 to form the hinge 19. In the embodiments shown in FIGS. 8 and 10 for example, the outermost peripheral portions of the respective transparent panel 30 and flexible mesh panel 130 are slid between the interior wall 16 defining said interior space and the exterior wall 15 and fastened thereto as by adhesive or mechanically by sewing for example. One way to accomplish this configuration of FIGS. 8 and 10, is for the cut to be defined completely around the viewing opening 18 through the interior wall 16 but not through the exterior wall 15 where the hinge 19 is formed. An alternative way to accomplish this configuration of FIGS. 8 and 10, is for the cut to be defined completely around the viewing opening 18 through both the interior wall 16 and the exterior wall 15 such that the flap 20 initially is completely detached and must be reattached to define the hinge 19.

Accordingly, the area of the viewing panel, whether composed of one or more transparent panel(s) 30 and/or flexible mesh panel(s) 130, will be much less than the overall surface area of the muff 110, 210, 310, 410, 510, 610, 710, 810, 910, 1010. However, the area and shape of the viewing panel, whether composed of one or more transparent panel(s) 30 and/or flexible mesh panel(s) 130, need not be identical to the area and shape of the viewing opening 18 through the cylindrical member 11 or to the area and shape of the cover flap 20. The configuration of the viewing panel, the viewing opening 18 and the cover flap 20 should be such that when the cover flap 20 is pivoted away from the main body of the cylindrical member 11, the user will be able to look through the viewing panel, whether composed of one or more transparent panel(s) 30 and/or flexible mesh panel(s) 130, and see the interior space inside of the muff 110, 210, 310, 410, 510, 610, 710, 810, 910, 1010. In this way, the user becomes able simultaneously to view and manipulate a hand-held device 24 such as a cell phone, a digital assistant, a global positioning device, an electronic calculator and the like handheld device. In this way for example, the user can send and read text messages by looking through the viewing panel, whether composed of one or more transparent panel(s) 30 and/or flexible mesh panel(s) 130, without withdrawing the user's hands from within the muff 110, 210, 310, 410, 510, 610, 710, 810, 910, 1010. The viewing panel, whether composed of one or more transparent panel(s) 30 and/or flexible mesh panel(s) 130, keeps the wearer's hands inside the muff and prevents the wearer's hands from being completely exposed to the elements when the wearer wants to see a device being held inside the muff.

As most easily seen in FIGS. 1, 2, 6-9E and 10 for example, the free edge of the cover flap 20 can be selectively connected to the main body of the hand muff by an attachment mechanism such as a zipper 20*a*, magnets 34*a*, 34*b*, hook and loop fasteners 44*a*, 44*b* or snaps. In this way the cover flap 20 is selectively detachable from the main body of the muff 10 so as to permit the user to see inside the muff 10 through the opening 18 and the transparent panel 30 when the free edge of the cover flap 20 is disconnected from the body of the muff 10. Moreover, in some embodiments such as shown in FIGS. 1 and 6, the cover flap 20 is selectively detachable by the user while the user's hands are disposed within the muff 10. Accordingly, with the user's hands disposed inside the muff 10, the user also can selectively connect the cover flap 20 to the body of the muff to close the opening 18 and provide increased insulation as the insulated cover flap 20 closes the opening 18 and covers the transparent panel 30 from inside the muff.

As most easily seen in FIGS. 7A, 7B, 7C, 8, 9A, 9B, 9C, 9D, 9E and 10 for example, in other envisioned embodiments, the cover flap 20 is selectively detachable to the cylindrical member 11 by the user while the user's hands are outside the muff 110, 210, 310, 410, 510, 610, 710, 810, 910 or 1010. Accordingly, with the user's hands outside the muff, the user also can selectively connect the free edge of the cover flap 20 to the body of the muff 110, 210, 310, 410, 510, 610, 710, 810, 910 or 1010 to close the opening 18, cover each transparent panel 30 and/or flexible mesh panel 130 and provide increased insulation as the insulated cover flap 20 overlays the opening 18 and each transparent panel 30 and/or flexible mesh panel 130 from outside the muff.

Figure 7A:
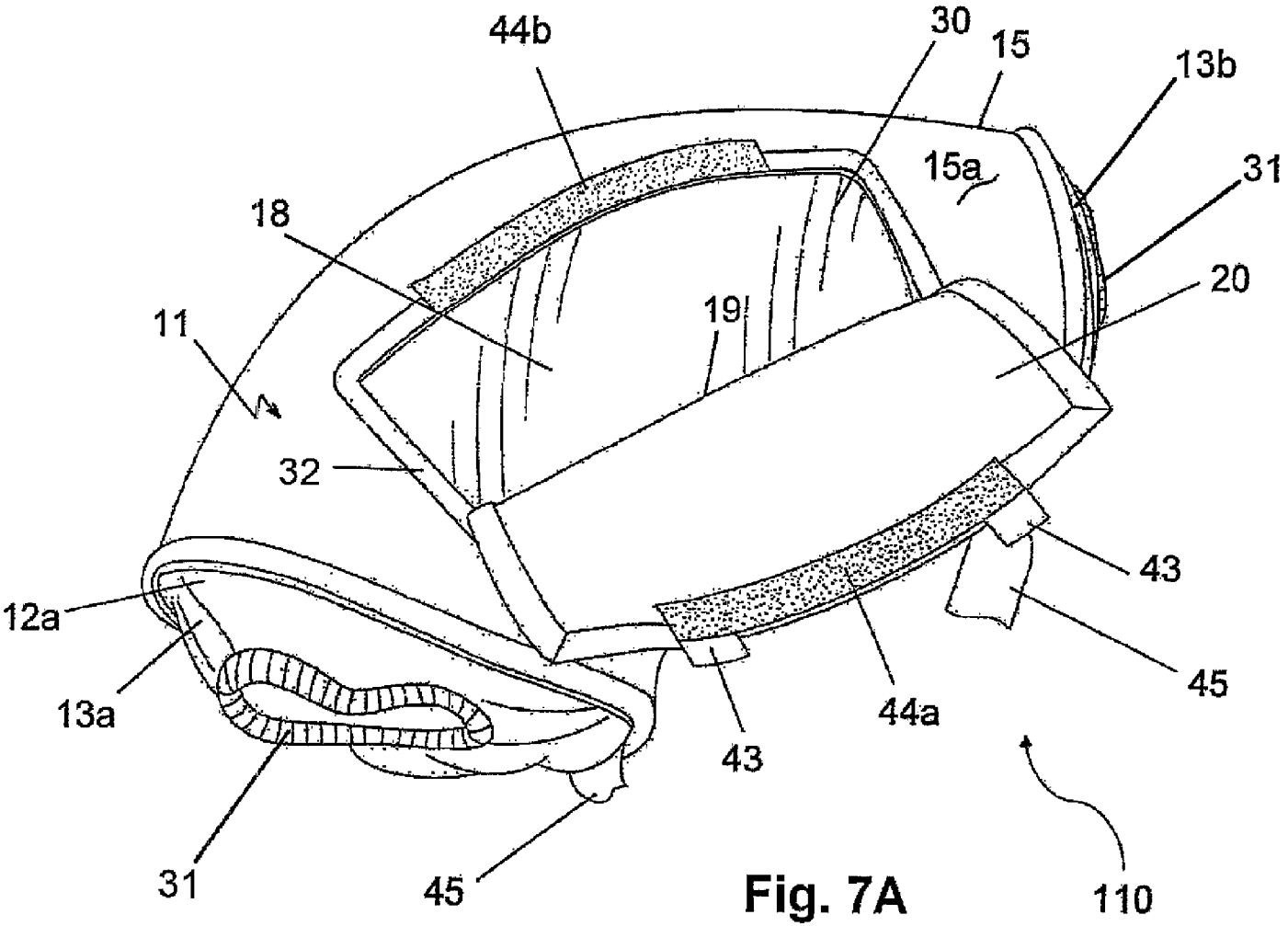
FIG. 7A is an elevated perspective view of another preferred embodiment of the muff of the present invention.
Figure 7B:
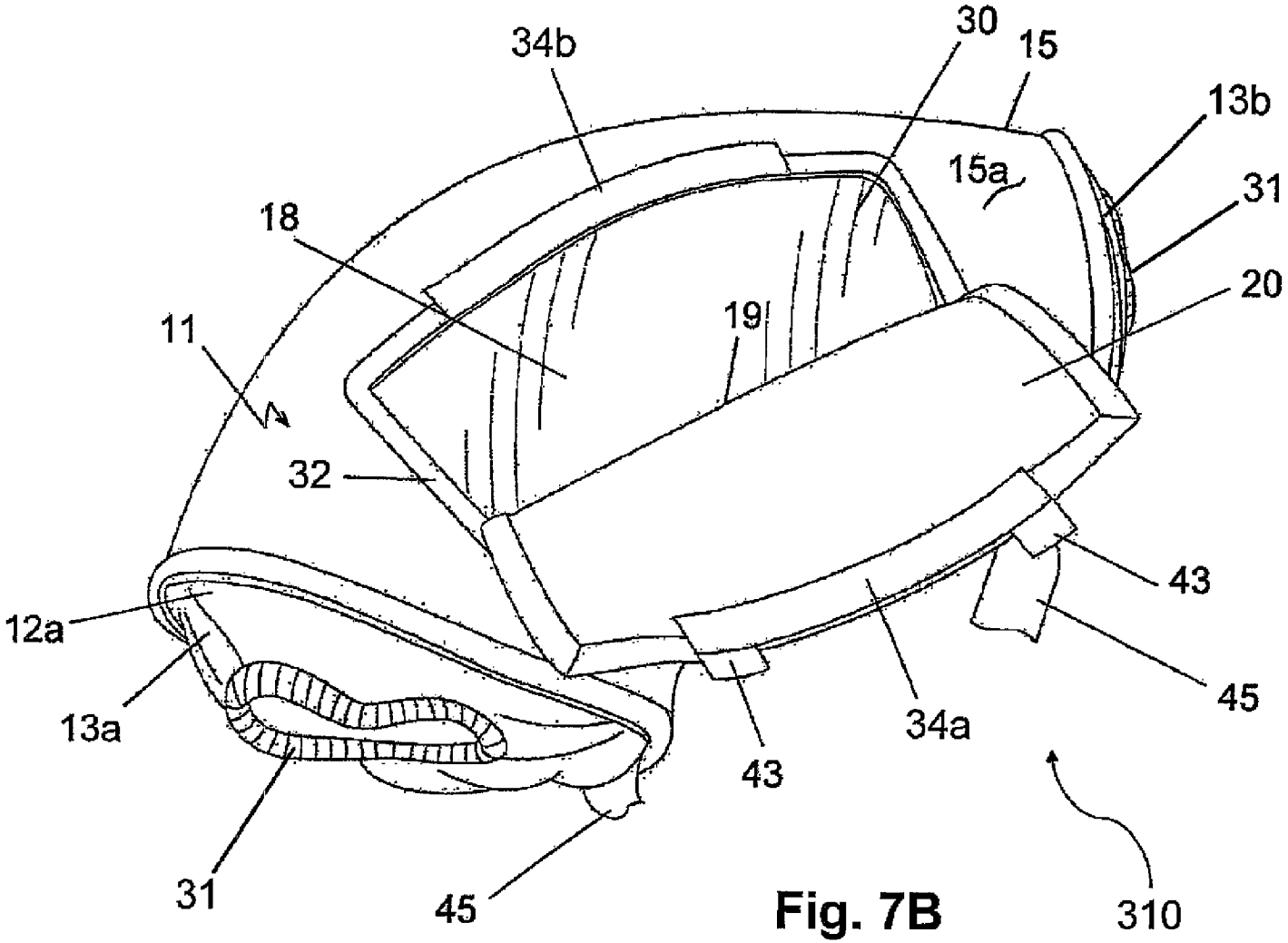
FIG. 7B is an elevated perspective view of another preferred embodiment of the muff of the present invention.
Figure 7C:
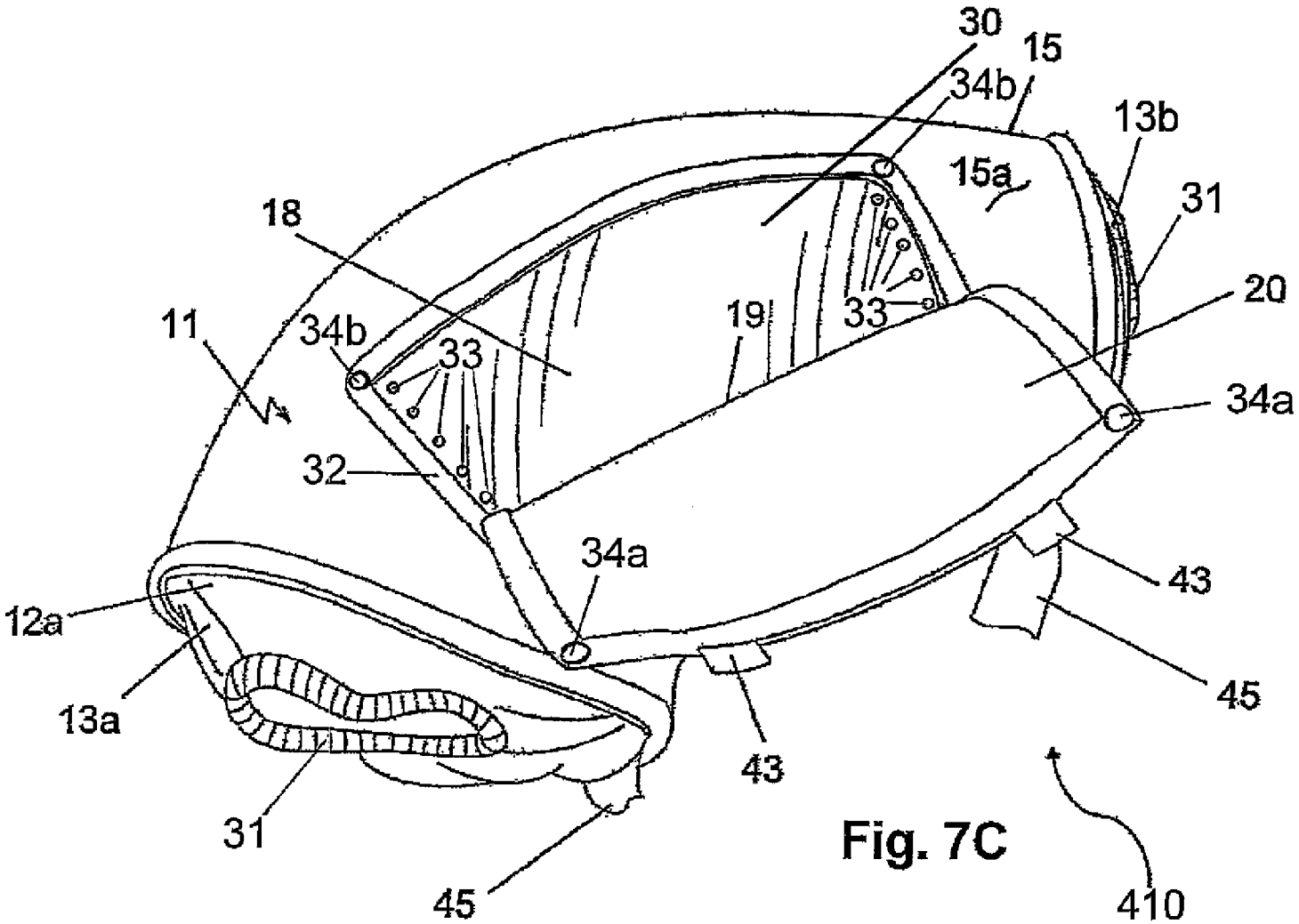
FIG. 7C is an elevated perspective view of another preferred embodiment of the muff of the present invention.
Figure 8:
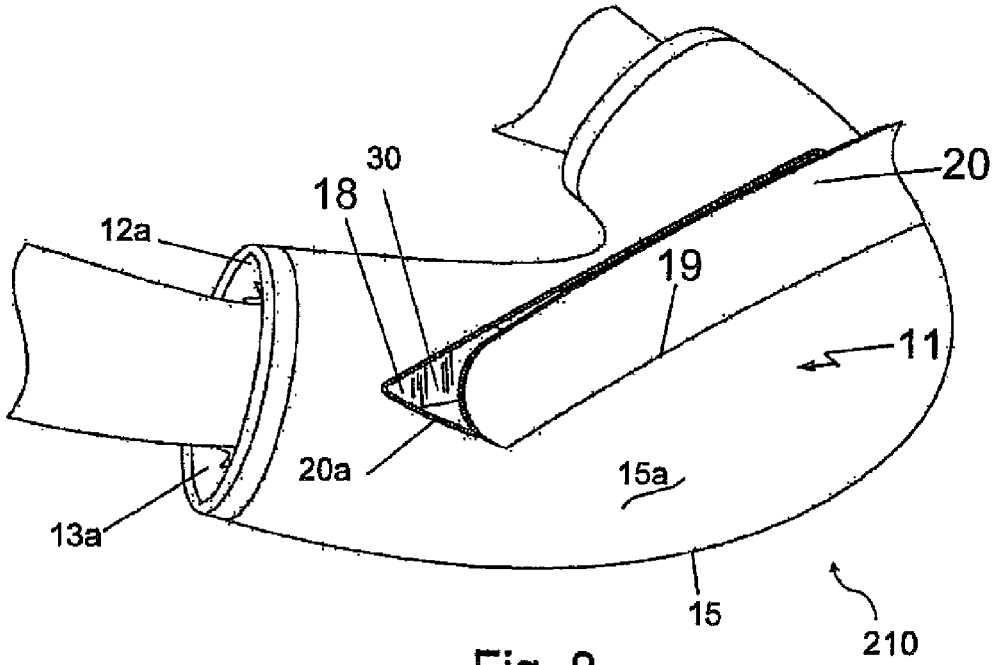
FIG. 8 is an elevated perspective view of another preferred embodiment of the muff of the present invention.

The free edge of the cover flap 20 can be selectively connected to and pivoted away from the main body of the hand muff by an attachment mechanism such as a zipper 20*a* as shown in FIGS. 8 and 10, or hook and loop fasteners as shown in FIGS. 7A and 9A or magnets 34*a*, 34*b* as shown in FIG. 7B, 7C, 9B, 9C, 9D or 9E or snaps (not shown), buttons (not shown), or a belt and buckle closure (not shown) or some other mechanical or adhesive fastener. Each attachment mechanism desirably can include at least one selectively disconnectable connecting element that desirably can be disposed between the cover flap 20 and the cylindrical side wall of the cylindrical member 11. The connecting element desirably is configured and disposed to permit the cover flap 20 to be selectively connected to and pivoted away from the cylindrical side wall of the cylindrical member 11.

As shown in FIGS. 7A and 9A, when hook and loop fasteners are used, a selectively disconnectable connecting element in the form of a hook strip 44*a* can be attached to the cover flap 20 and thus is disposed between the cover flap 20 and the cylindrical side wall of the cylindrical member 11. In this embodiment, another selectively disconnectable connecting element in the form of a loop strip 44*b* will be attached to the cylindrical side wall of the cylindrical member 11 of the muff 110, 510 and thus is disposed between the cover flap 20 and the cylindrical side wall of the cylindrical member 11. In this way the cover flap 20 is selectively detachable from the main body of the muff 110, 510 so as to permit the user to see inside the muff through the opening 18 and through each transparent panel 30 and/or flexible mesh panel 130 when the free edge of the cover flap 20 is disconnected from the main body of the muff.

As shown in FIGS. 7B, 9B and 9D, when magnets are used, a selectively disconnectable connecting element in the form of a flexible magnetic strip 34*a* can be attached to the cover flap 20 and thus is disposed between the cover flap 20 and the cylindrical side wall of the cylindrical member 11. Such flexible magnetic strip 34*a* can be formed as a composite of magnetic powders combined with various resins (e.g., vinyl) or binders that can be injection molded into various shapes, including strips 34*a*, 34*b* that will bend and flex with the cover flap 20 and the cylindrical side wall of the cylindrical member 11. In this embodiment, another selectively disconnectable connecting element in the form of either a magnet 34*b* of opposite polarity or a flexible strip of material to which a magnet will attach, will be attached to the muff 310, 710, 910 and thus is disposed between the cover flap 20 and the cylindrical side wall of the cylindrical member 11. In this way the cover flap 20 is selectively detachable from the main body of the muff 310, 710, 910 so as to permit the user to see inside the muff through the opening 18 and each transparent panel 30 and/or flexible mesh panel 130 when the free edge of the cover flap 20 is disconnected from the body of the muff.

As shown in FIGS. 7C and 9C, in other embodiments of a hand warmer 410, 810 using magnets, a selectively disconnectable connecting element in the form of magnetic disks 34*a* can be attached to the cover flap 20 and thus is disposed between the cover flap 20 and the cylindrical side wall of the cylindrical member 11. In this embodiment, another selectively disconnectable connecting element in the form of either a magnet 34*b* of opposite polarity or a disk formed of material to which a magnet will attach, will be attached to the muff 410, 810 and thus is disposed between the cover flap 20 and the cylindrical side wall of the cylindrical member 11. Such magnetic disks 34*a*, 34*b* can be positioned strategically, for example at the corners of the cover flap 20 and at the corresponding underlying positions on the cylindrical side wall or frame 32 of the cylindrical member 11. Other positions of the magnetic disks 34*a*, 34*b* and additional ones of the magnetic disks 34*a*, 34*b* can be employed. In this way the cover flap 20 is selectively detachable from the main body of the muff 410, 810 so as to permit the user to see inside the muff through the opening 18 and each transparent panel 30 and/or flexible mesh panel 130 when the free edge of the cover flap 20 is disconnected from the body of the muff.

One advantage of using magnets for at least one of the selectively disconnectable connecting elements is the ability to detach and attach the cover flap 20 from and to the cylindrical side wall of the cylindrical member 11 without making noise. Such silence is particularly appreciated by hunters stalking wild game.

in yet a further envisioned embodiment, a separate cover flap 20 can be provided on each of the outside and the inside of the muff and thereby cover each transparent panel 30 and/or flexible mesh panel 130 from each opposite side thereof.

Additionally, as shown in FIGS. 7A, 7B, 7C, 9A, 9B, 9C, 9D and 9E for example, tabs 43 desirably can be attached to the free edge of the cover flap 20 to assist the user in opening or closing the cover flap 20. Indeed, the wearer might open the cover flap 20 by gripping the tabs 43 between the wearer's teeth and tugging in a direction away from the main body of the muff and thus open the cover flap 20 without removing one of the wearer's hands from within the muff in order to accomplish this task. Furthermore, straps 45, partially shown in FIGS. 7A, 7B, 7C, 9A, 9B, 9C, 9D and 9E, may be attached to the hand warmer 110, 310, 410, 510, 610, 710, 810, 910, 1010 to facilitate carrying or transporting the muff 110, 310, 410, 510, 610, 710, 810, 910, 1010 when the muff is not in use.

Figure 3:
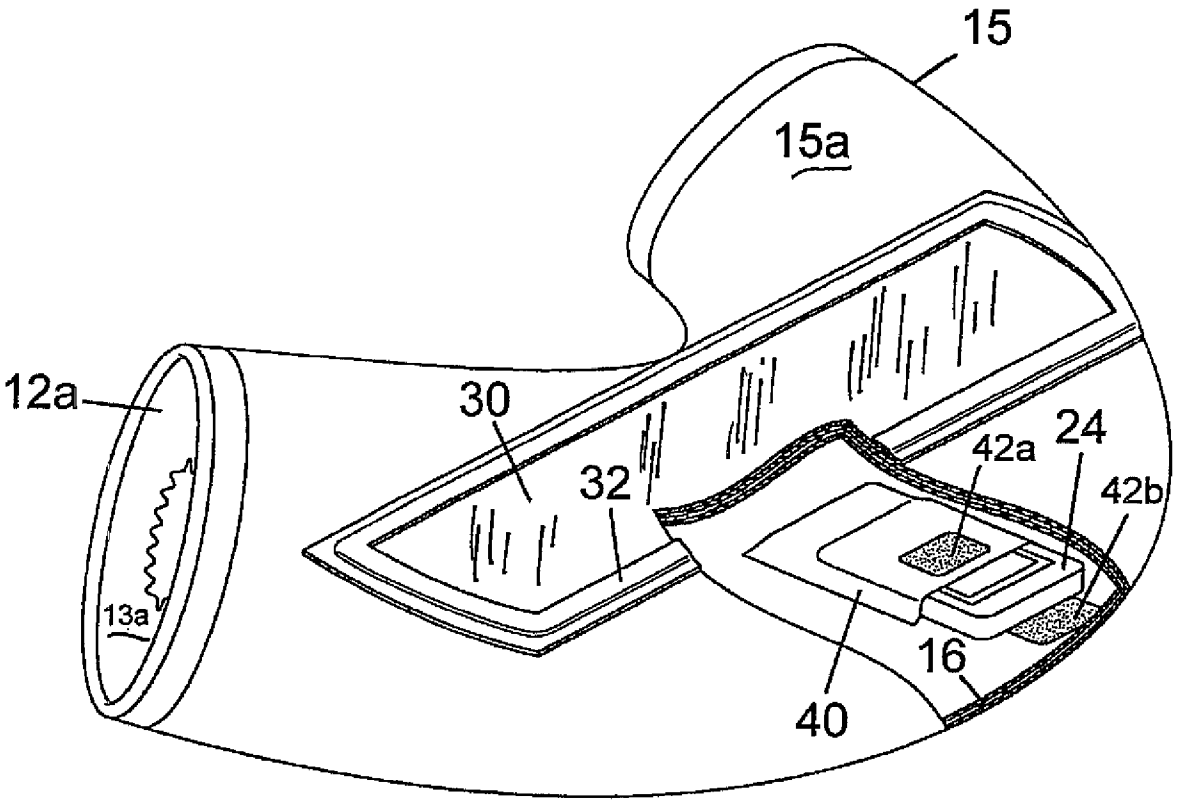
FIG. 3 is an elevated perspective view of the embodiment of FIG. 1 with portions partly cut away.
Figure 4:
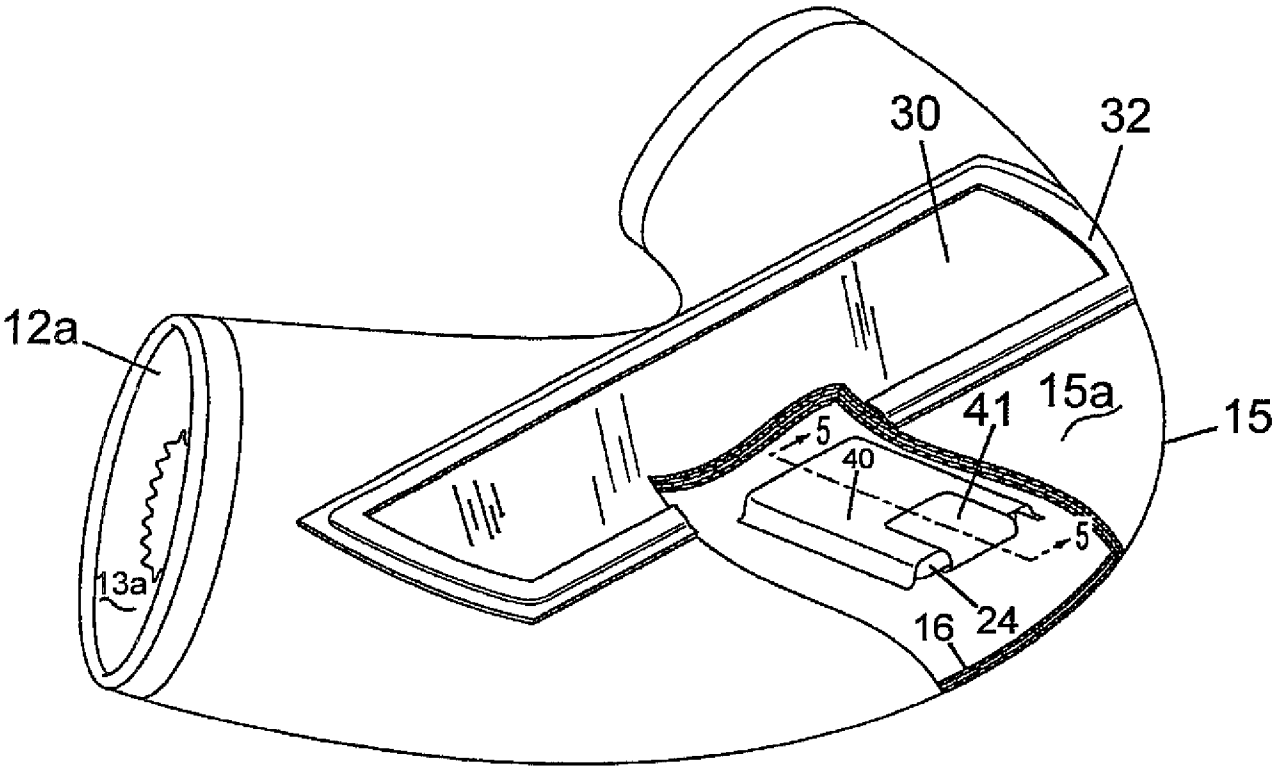
FIG. 4 is an elevated perspective view of the embodiment of FIG. 1 with portions partly cut away.
Figure 5:
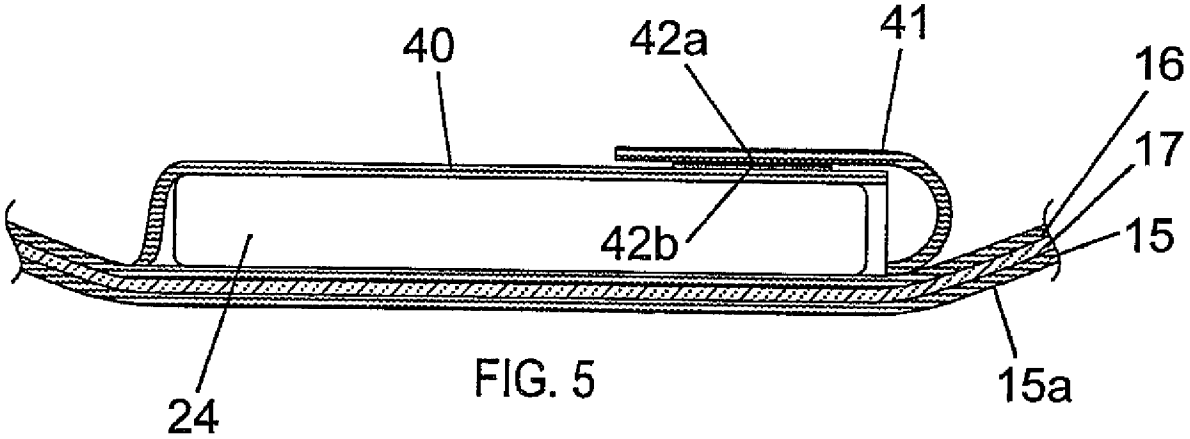
FIG. 5 is a cross-sectional view taken along the line of sight of the arrows designated by the numerals 5 in FIG. 4.

A pocket with an opening desirably is provided in the interior of the hand muff. As shown in FIGS. 3-6 for example, the interior of the hand muff 10 also desirably is provided with a pocket 40. The pocket 40 desirably is configured to receive a relatively small, hand-held device 24 such as a cell phone, a digital assistant, a global positioning device, an electronic calculator or the like. As shown in FIGS. 3-5 for example, the hand-held device 24 can be disposed within the pocket 40. The pocket 40 desirably is disposed on and attached to the interior wall 16 of the cylindrical member 11 and defines an opening thereto. The pocket 40 desirably is located generally opposite where the opening 18 is disposed. In one exemplary embodiment, the pocket 24 is formed at least in part by resiliently elastic material that is configured and disposed to hold the hand-held device in the pocket 40, yet permitting the user to selectively withdraw the hand-held device from within the pocket 40 as desired.

As shown in FIGS. 3-5 for example, in another exemplary embodiment, the pocket 40 also desirably is provided with a closure flap 41 at the opening to the pocket to secure therein the hand-held device. The pocket 40 and the closure flap 41 desirably can include an attachment mechanism such as hook and loop fasteners, or magnets, or a zipper or buttons, or a belt and buckle closure or one or more snap closures. The hand-held device can be held securely in the pocket 40 by effecting the closing of the closure 41 by attaching the snaps or the magnets or the hook and loop fasteners or zipping the zipper closed as the case may be. As an example of a suitable attachment mechanism, a hook and loop fastener 42*a*, 42*b* arrangement is shown in FIGS. 3 and 5.

In use, the person can place one's hand-held device 24 inside the pocket 40 inside the muff 10, 110, 210, 310, 410, 510, 610, 710, 810, 910, 1010. While one's hands are either outside the muff 110, 210, 310, 410, 510, 610, 710, 810, 910, 1010 or warm and snug inside the muff, one can disconnect the cover flap 20 and move the cover flap 20 away from each transparent panel 30 and/or flexible mesh panel 130 to enable the user to see inside the muff 10, 110, 210, 310, 410, 510, 610, 710, 810, 910, 1010. The user can open the pocket 40 and remove the hand-held device 24 from the pocket 40 and use the hand-held device 24 while both the user's hands and the device 24 remain warm inside the muff 10, 110, 210, 310, 410, 510, 610, 710, 810, 910, 1010. Each transparent panel 30 and/or flexible mesh panel 130 enables the user to view any displays transmitted to the device 24 or operate any features of the device 24 without removing the device 24 or the user's hands from within the muff 10, 110, 210, 310, 410, 510, 610, 710, 810, 910, 1010. Once the user is finished using the device 24, the user can replace the device 24 inside the pocket 40 and attach the closure 41 to the pocket 40 to secure the device 24 inside the muff 10, 110, 210, 310, 410, 510, 610, 710, 810, 910, 1010. The user then can close the cover flap 20 and reattach the cover flap 20 to the main body of the muff 10 while maintaining the user's hands completely inside the muff 10, as shown in FIGS. 1 and 6, or by taking them out of the muff 110, 210, 610, 710, 810, 910, 1010 and reattaching the cover flap 20 from outside the muff 110, 210, 310, 410, 510, 610, 710, 810, 910, 1010 as shown in FIGS. 7A, 7B, 7C, 8, 9A, 9B, 9C, 9D, 9E and 10.

The reattached cover flap 20 covers the inside facing surface, as shown in FIGS. 1 and 6, or the outside facing surface, as shown in FIGS. 7A, 7B, 7C, 8, 9A, 9B, 9C, 9D, 9E and 10, of each transparent panel 30 and/or flexible mesh panel 130 with the cover flap 20 and thereby restores the muff 10, 110, 210, 310, 410, 510, 610, 710, 810, 910, 1010 to its full heat insulating capability. With the cover flap 20 covering the inside facing surface of the transparent panel 30 as in FIG. 1 for example, the cover flap 20 protects the inside facing surface of the transparent panel 30 from being accidentally scratched by the stored device 24 or soiled by the user's hands. On the other hand, with the cover flap 20 covering the outside facing surface of each transparent panel 30 and/or flexible mesh panel 130 as in FIGS. 7A, 7B, 7C, 8, 9A, 9B, 9C, 9D, 9E and 10 for example, the cover flap 20 protects the outside facing surface of each transparent panel 30 and/or flexible mesh panel 130 from being accidentally scratched or soiled by the environment in which the muff 110, 210, 310, 410, 510, 610, 710, 810, 910, 1010 is stored. In yet a further envisioned embodiment, with a separate cover flap 20 on each of the outside and the inside of the muff, each opposite surface of each transparent panel 30 and/or flexible mesh panel 130 can be covered by one of the two cover flaps and thereby protect each opposite side of each transparent panel 30 and/or flexible mesh panel 130 from soiling or damage when the cover flaps are attached in their closed positions.

While more than one presently preferred embodiment of the invention has been described using specific terms, such descriptions are for illustrative purposes only, and it is to be understood that changes and variations may be made without departing from the spirit or scope of the invention.

What is claimed is:

1. A hand warmer for a human user, comprising:

a main body defining a generally cylindrical member that is non-rigid and includes heat-insulating material, the cylindrical member defining an interior space configured to receive therein the hands and wrists of the user, the cylindrical member defining a first end and a second end disposed generally opposite said first end, the cylindrical member defining an opening at each opposite end thereof, the cylindrical member defining a generally cylindrical side wall extending between the first end and the second end, the cylindrical side wall defining a viewing opening through said side wall;

a viewing panel connected to said cylindrical side wall and disposed across said viewing opening so as to be framed by said viewing opening, wherein said viewing panel includes at least one transparent panel disposed between a first mesh panel and a second mesh panel, the first mesh panel being disposed between the transparent panel and the first end of the cylindrical member, the second mesh panel being disposed between the transparent panel and the second end of the cylindrical member; and a cover flap pivotally connected to said cylindrical side wall and configured and disposed so as to selectively cover said viewing panel in a closed position and uncover said viewing panel in an open position.

2. A hand warmer as in claim 1, wherein at least one mesh panel is flexible.

3. A hand warmer as in claim 1, further comprising:

a selectively disconnectable connecting element disposed between said cover flap and said cylindrical side wall, the connecting element being configured and disposed to permit the cover flap to be selectively connected to and pivoted away from the cylindrical side wall.

4. A hand warmer as in claim 3, wherein said selectively disconnectable connecting element includes at least one magnet connected to at least one of said cover flap and said cylindrical side wall.

5. A hand warmer as in claim 3, wherein said selectively disconnectable connecting element includes at least one hook strip connected to at least one of said cover flap and said cylindrical side wail.

6. A hand warmer as in claim 3, wherein said selectively disconnectable connecting element includes at least one magnetic strip connected to at least one of said cover flap and said cylindrical side wall.

7. A hand warmer as in claim 1, further comprising:

a pocket connected to said cylindrical member and disposed within said interior space, said pocket defining an internal space configured to hold a hand-held device such as a cell phone, a digital assistant, a global positioning device, an electronic calculator and the like, said pocket defining an access opening configured to provide access to said internal space of said pocket.

8. A hand warmer as in claim 7, further comprising:

a closure connected to said pocket and to said cylindrical member and configured and disposed to selectively open and close said access opening.

9. A hand warmer as in claim 7, wherein said pocket is formed at least in part by resiliently elastic material that is configured and disposed to hold the hand-held device in said internal space while permitting the user to selectively withdraw the hand-held device from within said internal space.

10. A hand warmer as in claim 1, wherein the cylindrical side wall includes an interior wall defining said interior space, an exterior wall generally overlying said interior wall and defining the exterior surface of the hand warmer, and a layer of non-rigid, heat insulating material disposed between the interior wall and the exterior wall.

11. A hand warmer as in claim 10, wherein said cover flap pivotally connected to said interior wall of said cylindrical side wall and configured and disposed so as to selectively cover said viewing panel from within said interior space.

12. A hand warmer as in claim 10, wherein said cover flap pivotally connected to said exterior wall of said cylindrical side wall and configured and disposed so as to selectively cover said viewing panel from outside said interior space.

13. A hand warmer as in claim 1, wherein said cylindrical member includes a bend in the shape between the ends thereof.

14. A hand warmer for a human user, comprising:

a main body defining a generally cylindrical member that is non-rigid and includes heat-insulating material, the cylindrical member defining an interior space configured to receive therein the hands and wrists of the user, the cylindrical member defining a first end and a second end disposed generally opposite said first end, the cylindrical member defining an opening at each opposite end thereof, the cylindrical member defining a generally cylindrical side wall, the cylindrical side wall defining a viewing opening through said side wall;

a first cuff attached to the periphery of the opening at the first end of the cylindrical member and including an elastic portion defining a hole configured to grip around one of the user's forearms;

a second cuff attached to the periphery of the opening at the second end of the cylindrical member and including an elastic portion defining a hole configured to grip around the other one of the user's forearms;

a viewing panel connected to said cylindrical side wall and disposed across said viewing opening so as to be framed by said viewing opening, wherein said viewing panel includes at least one transparent panel disposed between a pair of mesh panels; and a cover flap pivotally connected to said cylindrical side wall and configured and disposed so as to selectively cover said viewing panel in a closed position and uncover said viewing panel in an open position;

a selectively disconnectable connecting element disposed between said cover flap and said cylindrical side wall, the connecting element being configured and disposed to permit the cover flap to be selectively connected to and pivoted away from the cylindrical side wall.

15. A hand warmer as in claim 14, further comprising:

a pocket connected to said cylindrical member and disposed within said interior space, said pocket defining an internal space configured to hold a hand-held device such as a cell phone, a digital assistant, a global positioning device, an electronic calculator and the like, said pocket defining an access opening configured to provide access to said internal space of said pocket.

16. A hand warmer as in claim 15, further comprising:

a closure connected to said pocket and to said cylindrical member and configured and disposed to selectively open and close said access opening.

17. A hand warmer as in claim 1, further comprising a first mechanical connector disposed between and connecting one edge of one mesh panel to one opposing edge of the transparent panel, a second mechanical connector being disposed between and connecting one edge of the other mesh panel to a second opposing edge of the transparent panel.

18. A hand warmer as in claim 14, further comprising a first mechanical connector disposed between and connecting one edge of one mesh panel to one opposing edge of the transparent panel, a second mechanical connector being disposed between and connecting one edge of the other mesh panel to a second opposing edge of the transparent panel.

19. A hand warmer as in claim 1, one edge of one mesh panel is fused to one opposing edge of the transparent panel, and one edge of the other mesh panel is fused to a second opposing edge of the transparent panel.

20. A hand warmer as in claim 14, one edge of one mesh panel is fused to one opposing edge of the transparent panel, and one edge of the other mesh panel is fused to a second opposing edge of the transparent panel.

* * * * *